US006619332B2

(12) United States Patent
Prunty

(10) Patent No.: US 6,619,332 B2
(45) Date of Patent: Sep. 16, 2003

(54) SNAP TIE BREAKER TOOL

(75) Inventor: Paul Edward Prunty, Escondido, CA (US)

(73) Assignee: Charles E. Dewhurst, San Diego, CA (US)

( * ) Notice: Subject to any disclaimer, the term of this patent is extended or adjusted under 35 U.S.C. 154(b) by 0 days.

(21) Appl. No.: 09/863,213

(22) Filed: May 22, 2001

(65) Prior Publication Data

US 2002/0174908 A1 Nov. 28, 2002

(51) Int. Cl.[7] ..... B21F 7/00
(52) U.S. Cl. ..... 140/123; 72/458; 225/102
(58) Field of Search ..... 140/123, 149; 225/102; 72/458, 479

(56) References Cited

U.S. PATENT DOCUMENTS

| | | | | | |
|---|---|---|---|---|---|
| 2,777,479 | A | * | 1/1957 | Beanum | 140/149 |
| 2,857,792 | A | * | 10/1958 | McNish | 72/458 |
| 3,174,517 | A | * | 3/1965 | Wilson | 140/123 |
| 3,546,919 | A | * | 12/1970 | Fial | 72/458 |
| 3,722,555 | A | * | 3/1973 | Voelsch | 140/123 |

OTHER PUBLICATIONS

Dayton/Richmond May 16, 2001 "A–3 Standard Snap Tie" http://www.daytonrichmond.com/products/lightforming/a3standard.html.

Dayton/Richmond May 16, 2001 "A–30 Break Back Wrench" http://www.daytonrichmond.com/products/lightforming/a30.html.

Dayton/Richmond May 16, 2001 "A–29 Snap Tie Wrench" http://www.daytonrichmond.com/products/lightforming/a29.html.

* cited by examiner

*Primary Examiner*—Lowell A. Larson
(74) *Attorney, Agent, or Firm*—Gary L. Eastman

(57) ABSTRACT

A snap tie breaker tool includes a handle connected to a body shaft with a locking brace and two receiving tubes attached to the body shaft. The snap tie breaker tool operates by sliding a concrete snap tie through both receiving tubes. The portion of the concrete snap tie that passes through both receiving tubes is then bent to a position perpendicular to its original position. Next, the handle is rotated so that the bent portion of the concrete snap tie contacts the body shaft. Once contact is made, an increased amount of force is applied to continue rotating the handle and the concrete snap tie. Eventually, the concrete snap tie will break and can be removed from the concrete wall. The process of breaking the concrete snap tie with the snap tie breaker tool is substantially less time consuming and takes less work than conventional methods.

17 Claims, 6 Drawing Sheets

SNAP TIE BREAKER TOOL

FIELD OF THE INVENTION

The present invention relates generally to tools that aid in the formation of concrete walls. More specifically, the present invention pertains to tools that break concrete snap ties. The present invention is particularly, though not exclusively, useful for bending and breaking concrete snap ties that are used for holding wood forms in place while concrete cures.

BACKGROUND OF THE INVENTION

The curing of concrete plays an integral role in the formation of concrete walls. The process of forming a concrete wall typically starts by installing rebar into the ground vertically. Rebar is positioned in concrete walls to give vertical and lateral support to the cured concrete. Next, plywood is secured in a vertical position to surround both sides of the area where the concrete will eventually be poured. Two-by-fours (2×4's) are then lined vertically on the outside of the plywood to give support against the pressure from the weight of wet concrete, once it is poured. Concrete snap ties ("snap ties") are long metal rods used to give lateral support to the two-by-fours (2×4's) and plywood. The snap ties travel horizontally through both sets of plywood and two-by-fours (2×4's). Anchors are attached to the snap tie just inside of the plywood form and stop the plywood form from moving past a designated point where the concrete will be poured. Walers, often called wedges, are wood or plastic blocks that have crevices shaped to receive the end of a snap tie and are used to keep the two-by-fours (2×4's) from moving. The waler contacts the two-by-four (2×4) and slides around the snap tie. The waler presses against the two-by-four (2×4) and pulls on the snap tie on both sides of the structure, resulting in a stable wood structure. The concrete is now ready to be poured into the center between the plywood and around the rebar.

Once the concrete has been poured and has time to cure, the walers, two-by-fours (2×4's) and plywood form are removed. The last and most critical stage is the breaking of the snap tie. In anticipation for this step, the snap ties have grooves, or break backs, etched or formed so they will break at a pre-determined location. The grooves are located just inside the plywood form so that an epoxy filler can cover the remaining portion of the snap tie. Usually, snap ties are bent back and forth until they break, leaving the remainder of the snap tie inside the cured concrete. The process of breaking the snap ties is difficult because they are made of thick bars of metal. Pipes are often used to slide around the snap ties and bend the snap ties back and forth until they break. Even though each snap tie is pre-formed with a groove, it is very difficult and time consuming to break off the concrete snap ties.

SUMMARY OF THE PRESENT INVENTION

The snap tie breaker tool of the present invention is used to break a concrete snap tie ("snap tie") and includes a handle connected to a body shaft with a locking brace and two receiving tubes welded to the body shaft.

The process of breaking a snap tie with the snap tie breaker tool starts by sliding the snap tie into the first receiving tube and then the second receiving tube. The portion of the snap tie that is outside the second receiving tube is then bent to a ninety (90) degree angle or perpendicular from the stationary portion of the snap tie. When the outside portion of the snap tie is bent to a ninety (90) degree angle, the handle is rotated in either a clockwise or counter-clockwise direction. The outside portion of the snap tie will contact the hinge and the rotation of the handle will be resisted by the snap tie.

A larger amount of force will be needed to rotate the handle further. As an adequately large amount of force is applied, the snap tie will begin to rotate until it breaks at its weakest point. Because the snap tie has been pre-grooved at a designated point just inside the plywood form, this is the weakest point and will break first. The snap tie is broken and can be removed from the structure leaving a small gap in the concrete where the snap tie was once located. The concrete wall is now ready for filler to be spread over the gap that was once a snap tie.

DESCRIPTION OF THE DRAWINGS

The novel features of this invention, as well as the invention itself, both as to its structure and its operation, will be best understood from the accompanying drawings, taken in conjunction with the accompanying description, in which like reference characters refer to similar parts, and in which.

DETAILED DESCRIPTION

Figure 1:
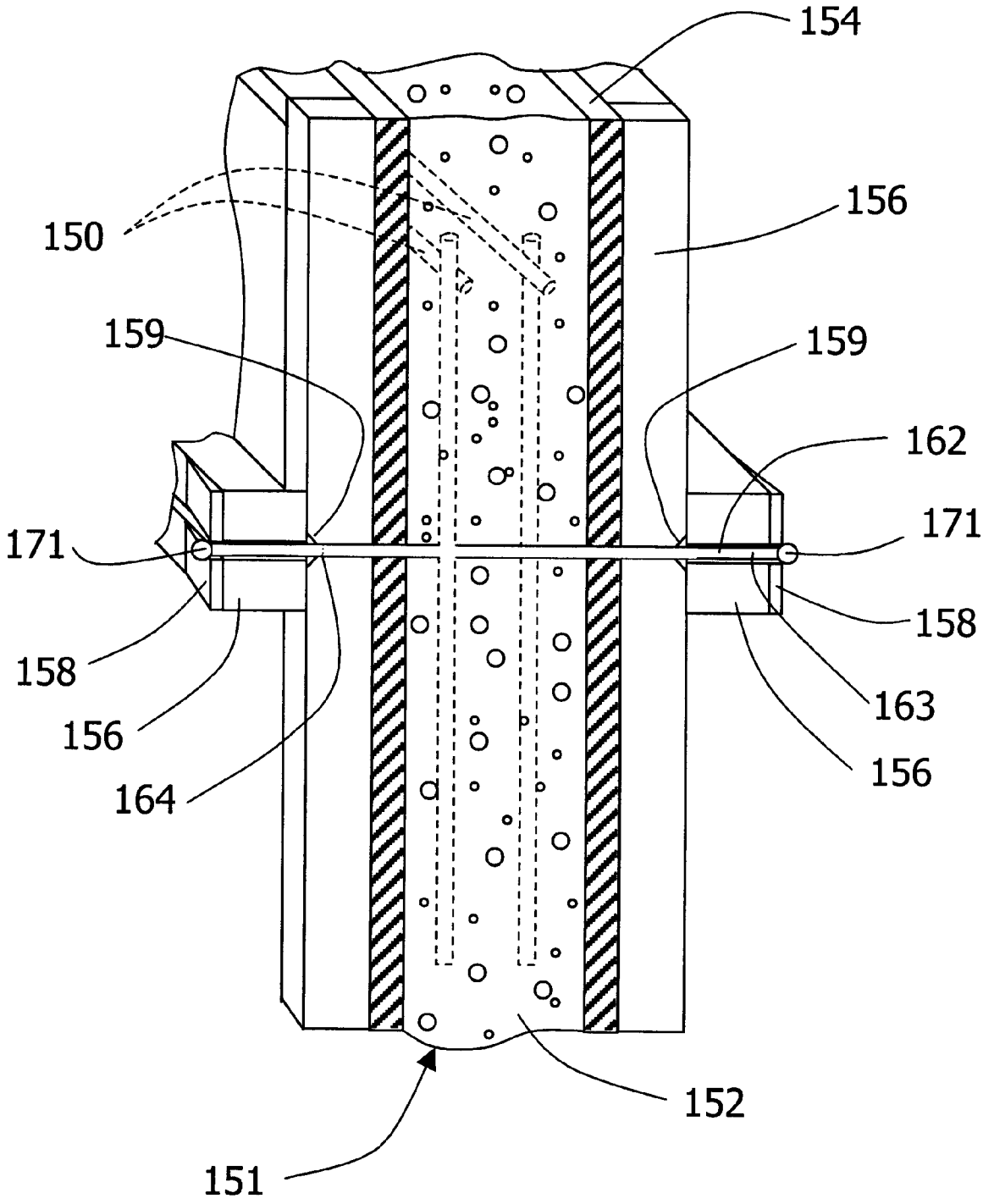
FIG. 1 is a side view of a form for pouring a concrete wall showing a plywood and two-by-four (2×4) frame, with a concrete snap tie extending through the wall.

Referring initially to FIG. 1, a side view of a prior art form for pouring a concrete wall is shown. Specifically, a concrete wall 151 includes rebar 150 positioned inside wet concrete 152, and held in place by plywood form 154 and wedge 158 contacting a two-by-four (2×4) frame 156 and concrete snap tie 162. Snap tie 162 includes an upper portion 163 formed with an anchor 159 and a head 171 that extends through two-by-four frame 156 and is positioned within wedge 158. Once assembled, snap tie 162 holds plywood 154 tightly against anchor 159 to provide for a wall having a consistent thickness.

As shown in FIG. 1, snap tie 162 is formed with a preparation cut, or break back, 164. This preparation cut 164 establishes a predetermined break location along the length of the snap tie 162. Thus, as will be described more thoroughly in conjunction with FIGS. 5 and 6, once the wall is formed, the end portion of the snap tie may be easily removed from the cured concrete wall.

Figure 2:
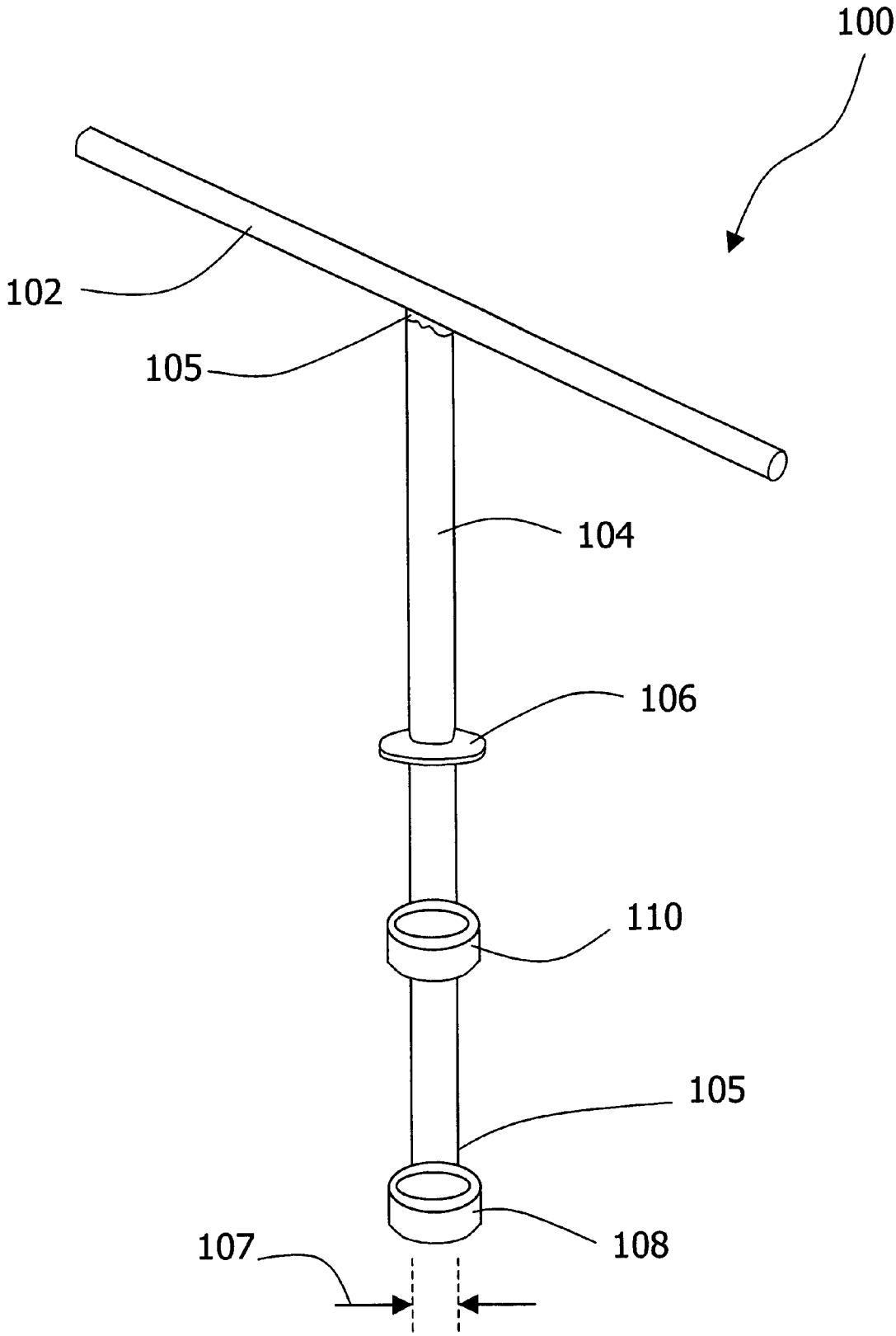
FIG. 2 is a perspective view of the preferred embodiment of the Snap Tie Breaker Tool of the present invention.

Referring now to FIG. 2, a perspective view of the preferred embodiment of the Snap Tie Breaker Tool of the present invention is shown and generally designated 100. Snap Tie Breaker Tool 100 includes handle 102 connected to the first end of body shaft 104. In a preferred embodiment, shaft 104 attaches to the approximate midpoint of handle 102 to form a "T".

Locking brace 106 is attached to the body shaft 104, above a first receiving tube 108 and a second receiving tube 110 located adjacent the end 105 of body shaft 104. First receiving tube 108 and second receiving tube 110 are substantially axial to each other and together define a bore for receiving a snap tie 162, and formed with an internal diameter 107 sized large enough to receive snap tie 162.

In a preferred embodiment, handle 102, shaft 104, locking brace 106, first receiving tube 108 and second receiving tube 110 may be made of steel or aluminum, or other strong material known in the art. Handle 102, locking brace 106, first receiving tube 108 and second receiving tube 110 may be connected to body shaft 104 by a weld 103, or any other method of attaching two metals together as is known in the art.

OPERATION

The operation of Snap Tie Breaker Tool 100 starts when concrete snap tie 162 is inserted through first receiving tube 108 and second receiving tube 110. The portion of concrete snap tie 162 that is outside second receiving tube 110 is then bent to approximately a ninety (90) degree angle, or bent position 170. Handle 102 is then rotated in a clockwise or counter-clockwise direction until concrete snap tie 162, in bent position 170, contacts body shaft 104. Further rotational force will break concrete snap tie 162 at break back 164.

Figure 3:
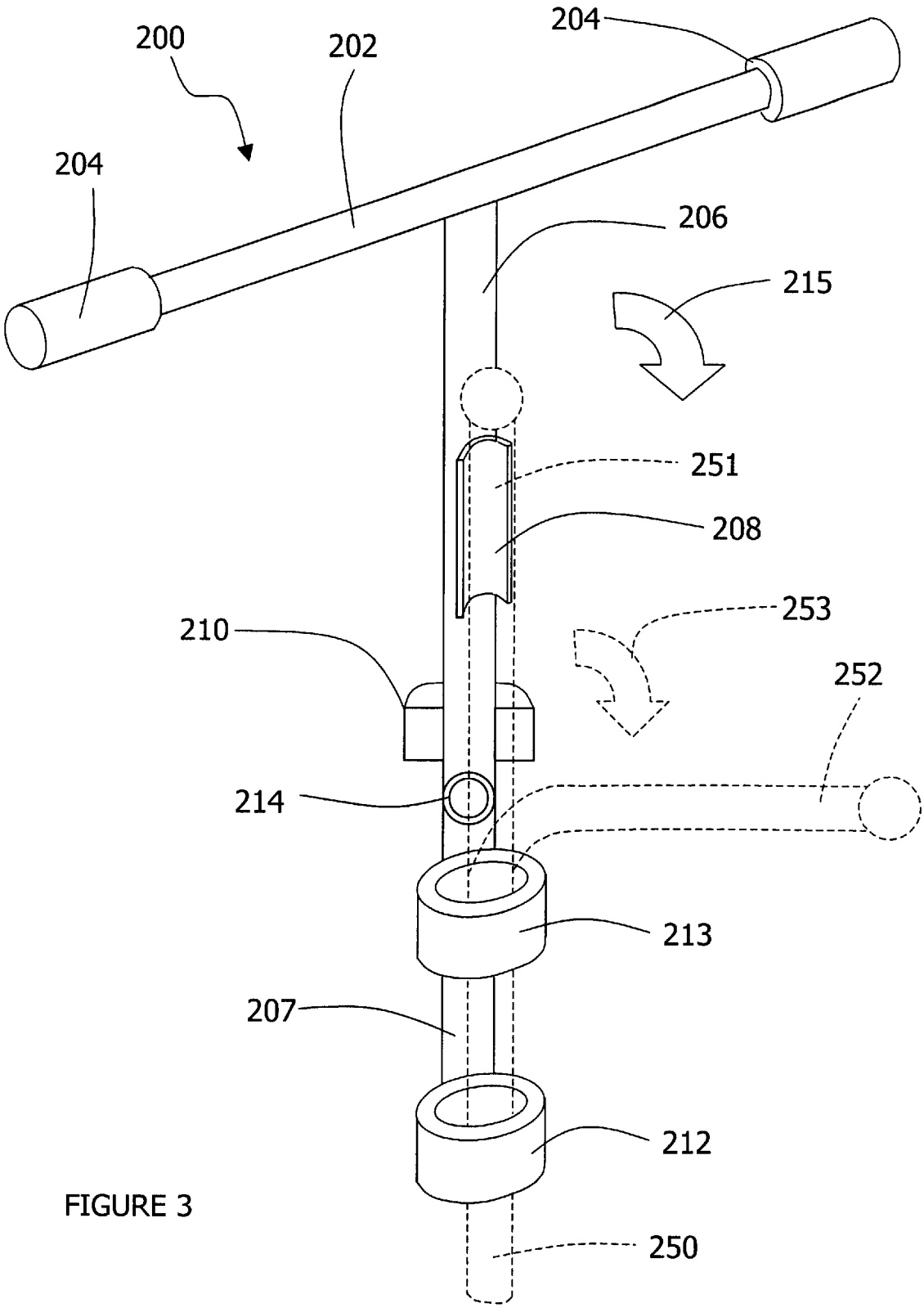
FIG. 3 is a perspective view of an alternate embodiment of the Snap Tie Breaker Tool of the present invention as it is engaged with a concrete snap tie.

FIG. 3 is a perspective view of an alternate embodiment of the Snap Tie Breaker Tool 100 of the present invention is generally designated 200 and is shown as it is engaged with concrete snap tie 250. Alternate embodiment 200 includes handle 202 with grips 204, upper body shaft 206 with cradle 208 and locking brace 210 attached, first receiving tube 212 and second receiving tube 213 are attached to lower body shaft 207. Upper body shaft 206 may pivot about hinge 214 in a direction 215 from a substantially colinear position to to lower body shaft 207, to an angled position, such as between one hundred eighty (180) to ninety (90) degrees.

Cradle 208 is used to bend the upper portion 152 of concrete snap tie 250 to bent position 252. The process starts by sliding concrete snap tie 250 through first receiving tube 212 and then second receiving tube 213 until it passes cradle 208. Next, handle 202 and upper body shaft 206 are pivoted in direction 215 so that upper body shaft 206 is in a position up to perpendicular to lower body shaft 207. Cradle 208 makes contact with concrete snap tie 251 and bends upper portion in direction 253. Handle 202 and upper body shaft 206 then pivot back to their original position leaving upper concrete snap tie 251 in bent position 252. Finally, handle 202 is rotated in either a clockwise or counter-clockwise direction so that upper concrete snap tie 251, now in position 252, contacts hinge 214. Handle 202 is rotated further until concrete snap tie 250 breaks at break back 164 (not shown this Figure).

Figure 4:
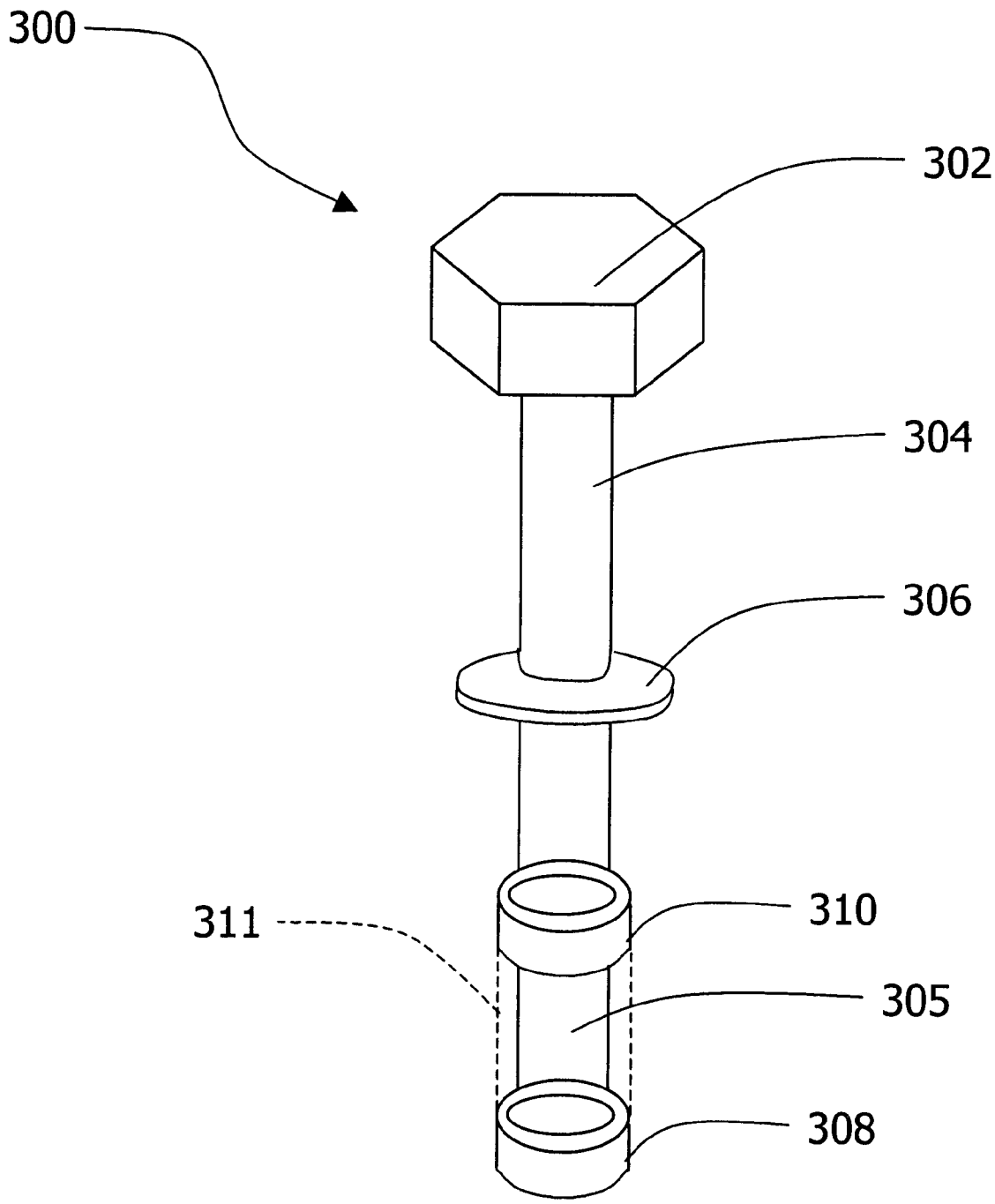
FIG. 4 is a perspective view of an alternate embodiment of the Snap Tie Breaker Tool of the present invention.

Preferably handle 202, body shaft 206, cradle 208 and enclosed receiving tube 212 may be composed of aluminum or other lightweight and strong metal that can bend concrete snap tie 250. Hinge 214 may be composed of metal or other strong material that has the ability to pivot. It should also be noted that grips 204 may be composed of rubber or other material known in the art that can give a user a cushioned or friction-enhancing grip. FIG. 4 is a perspective view of an alternate embodiment of the Snap Tie Breaker Tool 100 of the present invention and is generally designated 300. Alternate embodiment 300 includes hex-head 302 connected to the end of upper body shaft 304, locking brace 306 is welded to upper body shaft 304, first receiving tube 308 and second receiving tube 310 are attached to lower body shaft 305.

The operation of alternate embodiment 300 includes inserting a snap tie into first receiving tube 308 and second receiving tube 310 and then bending the end portion of the snap tie, such as by using a separate pipe. Once the snap tie is inserted and bent, hex-head 302 may be rotated with a tool to break the concrete snap tie at the break back 164. A variety of tools can be used to rotate hex-head 302, such as a socket and manual ratchet or air powered ratchet tool, or other tools known in the art.

In a preferred embodiment, hex-head 302, body shaft 304, locking brace 306, first receiving tube 308 and second receiving tube 310 may be composed of aluminum or other material that is strong, lightweight and known in the art. Hex-head 302 may have compatible measurements to fit the Standard or Metric sized sockets. It should also be noted that first receiving tube 308 and second receiving tube 310 may be combined to form an extended receiving tube 311 (shown in dashed lines).

Figure 5:
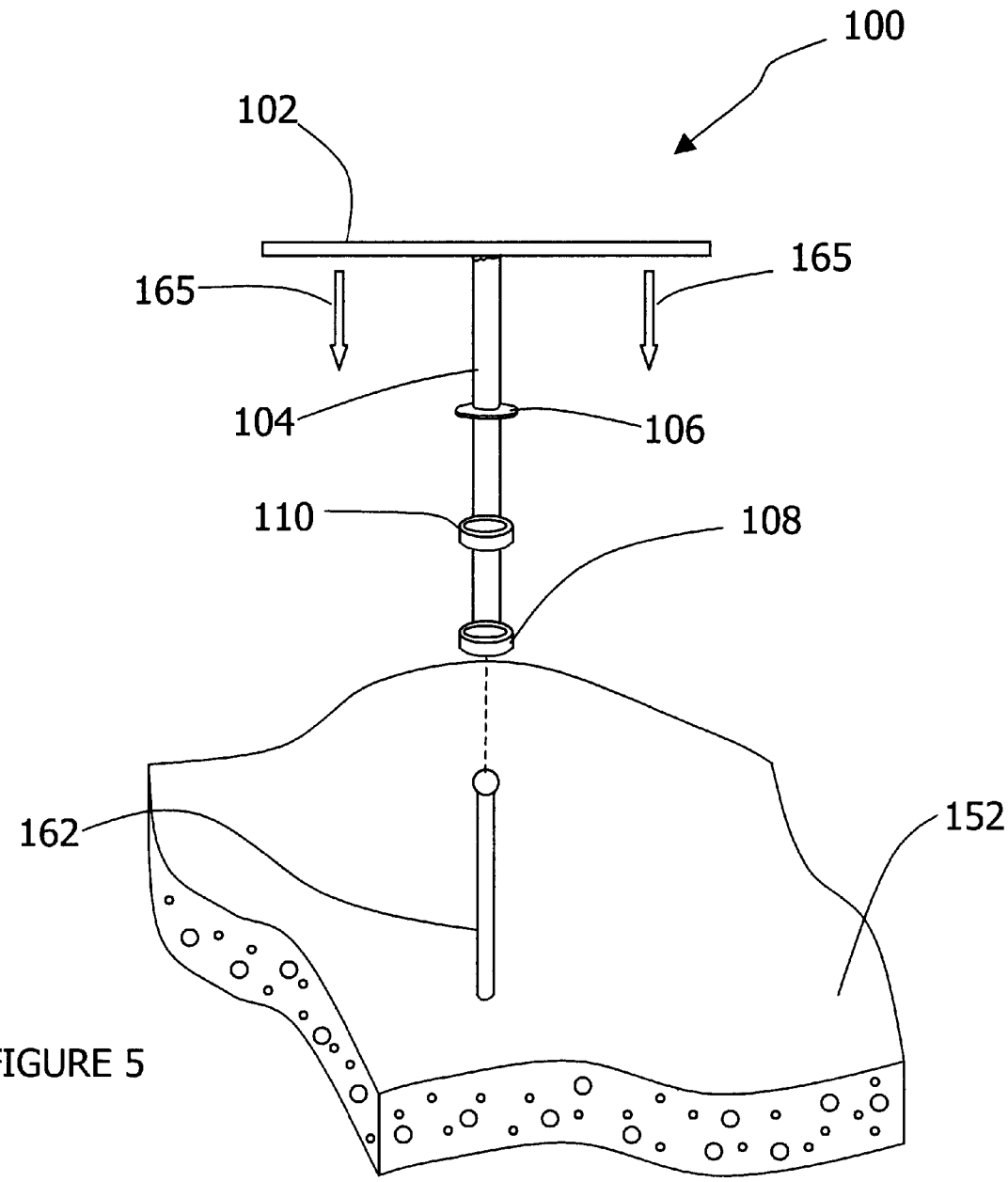
FIG. 5 is a detailed view of the concrete snap tie extending from a poured concrete wall, with a Snap Tie Breaker Tool of the present invention shown in preparation for placement over the snap tie.
Figure 6:
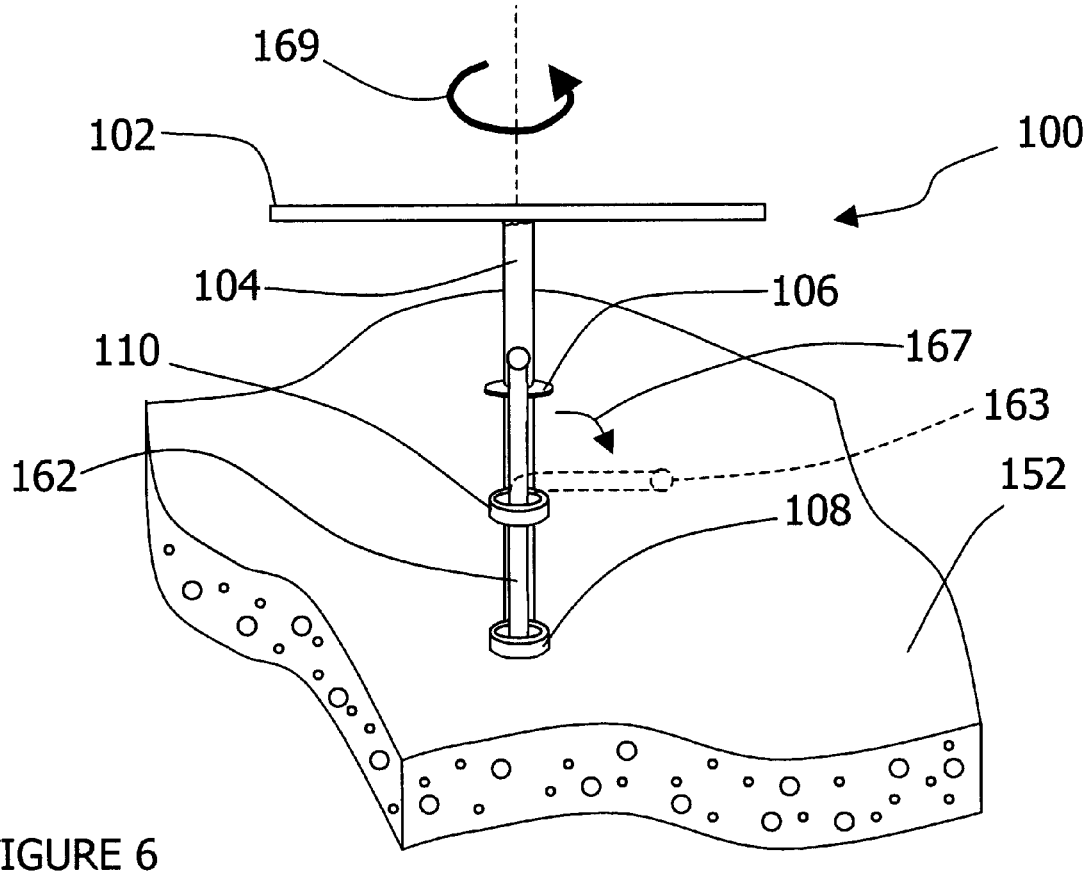
FIG. 6 is a detailed view of the Snap Tie Breaker Tool being used to remove the protruding portion of the snap tie from the wall by rotating the tool.

Referring now to FIGS. 5 and 6, the Snap Tie Breaker Tool 100 of the present invention is shown as used to remove the protruding portion of a snap tie 162 from a cured concrete wall 152. In FIG. 5, the poured concrete has at least partially cured, and plywood form 154, waler 158 and two-by-fours (2×4) 156 have been removed. In use, Snap Tie Breaker Tool 100 is positioned in line with a snap tie 162, and lowered in direction 165 such that snap tie 162 passes through first receiving tube 108 and second receiving tube 110 until first receiving tube 108 contacts concrete 152. Once in position, as shown in FIG. 6, the upper portion 163 of the snap tie 162 is bent in direction 167 by any means know in the art, such as a tube being placed over the upper portion 163 and manually bending the snap tie 162 in direction 167. Once the snap tie 162 is bent, the handle 102 is rotated about shaft 104 causing the snap tie 162 to twist and break at break back 164.

While the snap tie breaker tool of the present invention as herein shown and disclosed in detail is fully capable of obtaining the objects and providing the advantages herein before stated, it is to be understood that it is merely illustrative of preferred embodiments of the invention and that no limitations are intended to the details of construction or design herein shown other than as described in the appended claims.

I claim:

1. A snap tie breaker tool comprising:

a body shaft having a first end and a second end;

a handle extending from said first end of said body shaft;

a first receiving tube attached to said body shaft adjacent said second end of said body shaft;

a second receiving tube attached to said body shaft between said first receiving tube and said handle wherein said first receiving tube and said second receiving tube are substantially axial defining an axis.

2. The snap tie breaker tool in claim 1, wherein said handle further comprises a grip.

3. The snap tie breaker tool in claim 1, wherein said handle is substantially perpendicular to said body shaft.

4. The snap tie breaker tool in claim 1, wherein said body shaft and said handle form a "T".

5. The snap tie breaker tool in claim 1, wherein said body shaft further comprises a hinge located between said first end and said second receiving tube to define an upper body shaft and a lower body shaft, wherein said lower body shaft and said upper body shaft articulate about said hinge from a first position wherein said lower body shaft and said upper body shaft are substantially collinear, to a second position wherein said bower body shaft and said upper body shaft are at an angle.

6. The snap tie breaker tool of claim 5, wherein said angle is between one hundred eighty (180) and ninety (90) degrees.

7. The snap tie breaker tool of claim 5, further comprising a cradle positioned on said body shaft between said first receiving tube and said handle and on said axis.

8. The snap tie breaker tool in claim 7, wherein said cradle receives a portion of a concrete snap tie.

9. A snap tie breaker tool comprising:

a body shaft having a first end and a second end;

a handle extending from said first end of said body shaft; and an extended receiving tube attached to body shaft adjacent said second end of said body shaft wherein said extended receiving tube defines an axis, and wherein said axis is parallel to said body shaft.

10. The snap tie breaker tool in claim 9, wherein said handle further comprises a grip.

11. The snap tie breaker tool in claim 9, wherein said handle is substantially perpendicular to said body shaft.

12. The snap tie breaker tool in claim 9, wherein said body shaft and said handle form a "T".

13. The snap tie breaker tool in claim 9, wherein said body shaft further comprises a hinge located between said locking brace and said extended receiving tube to define an upper body shaft and a rower body shaft, wherein said lower body shaft and said upper body shaft articulate about said hinge from a first position wherein said lower body shaft and said upper body shaft are substantially collinear, to a second position wherein said lower body shaft and said upper body shaft are at an angle.

14. The snap tie breaker tool of claim 9, further comprising a cradle positioned on said body shaft between said extended receiving tube and said handle and on said axis.

15. The snap tie breaker tool in claim 14, wherein said cradle receives a portion of a concrete snap tie.

16. A snap tie breaker tool comprising:

a body shaft having a first end and a second end;

a head attached to first end of said body shaft;

a first receiving tube on said body shaft adjacent to said second end of said body shaft;

a second receiving tube attached to said body shaft between said first receiving tube and said head.

17. The snap tie breaker tool of claim 16, wherein said head is formed with a hexagonal shape.

* * * * *